United States Patent [19]

Dimond

[11] Patent Number: 4,784,104

[45] Date of Patent: Nov. 15, 1988

[54] FUEL LINE WITH INTEGRAL CO-AXIAL RETURN LINE

[75] Inventor: Danny L. Dimond, Neenah, Wis.

[73] Assignee: Brunswick Corporation, Skokie, Ill.

[21] Appl. No.: 63,650

[22] Filed: Jun. 18, 1987

[51] Int. Cl.[4] ..... F02M 39/00

[52] U.S. Cl. ..... 123/514; 123/516; 123/468

[58] Field of Search ..... 123/516, 514, 557, 510, 123/511, 512, 468

[56] References Cited

U.S. PATENT DOCUMENTS

| | | | |
|---|---|---|---|
| 4,320,734 | 3/1982 | Balachandran | 123/514 |
| 4,478,197 | 10/1984 | Yasuhara | 123/514 |
| 4,481,931 | 11/1984 | Druner | 123/514 |
| 4,483,285 | 11/1984 | Donnerstag | 123/514 |
| 4,502,451 | 3/1985 | Duprez | 123/514 |
| 4,543,938 | 10/1985 | Szlaga | 123/514 |

*Primary Examiner*—Carl Stuart Miller

*Attorney, Agent, or Firm*—Andrus, Sceales, Starke & Sawall

[57] ABSTRACT

A fuel system for an internal combustion engine having a fuel pump (14) communicating with a fuel tank (12) and delivering fuel to a fuel monitoring device (18) and including a device (18) for detecting and returning excess or vaporized fuel to the tank (12) is provided with a return fuel line for returning the detected vaporized or excess fuel to the tank with at least a portion of the return fuel line co-axial with and contained within the supply line.

5 Claims, 1 Drawing Sheet

FUEL LINE WITH INTEGRAL CO-AXIAL RETURN LINE

BACKGROUND AND SUMMARY OF THE INVENTION

This invention relates to a fuel supply and fuel return system for an internal combustion engine and more particularly to an integral and co-axial supply and return line system.

In a fuel system for an internal combustion engine, it is desirable to have a fuel return line that will return excess fuel or fuel vapors to the storage tank so as to prevent vaporlock conditions within the internal combustion engine.

In the automotive industry, separate lines are used for fuel supply and fuel return. However, in the marine industry, separate return fuel lines are generally unacceptable due to the fact that any failure or leak of the return fuel line will cause fuel to be pumped or leaked into the compartments surrounding the return line e.g., bilge, engine compartment, etc. Since the operation of the engine is not interrupted by such a leak, a leak of this type may be undetected for a considerable amount of time and may thus lead to unsafe conditions on the boat.

The present invention provides a fuel return line that is integral with, co-axial with and contained within the fuel supply line so that any leak in the return line is contained by the fuel supply line.

In accordance with another aspect of the invention, the end of the return line communicating with the fuel tank is disposed above the level of the fuel in the fuel tank and the pressure in the return line is greater than that in the supply line so that a rupture in the return line cause air from the fuel tank to be introduced into the supply line which causes the engine to cease operating.

BRIEF DESCRIPTION OF THE DRAWINGS

The drawings illustrate the best mode presently contemplated of carrying out the invention.

In the drawings.

DETAILED DESCRIPTION

Figure 1:
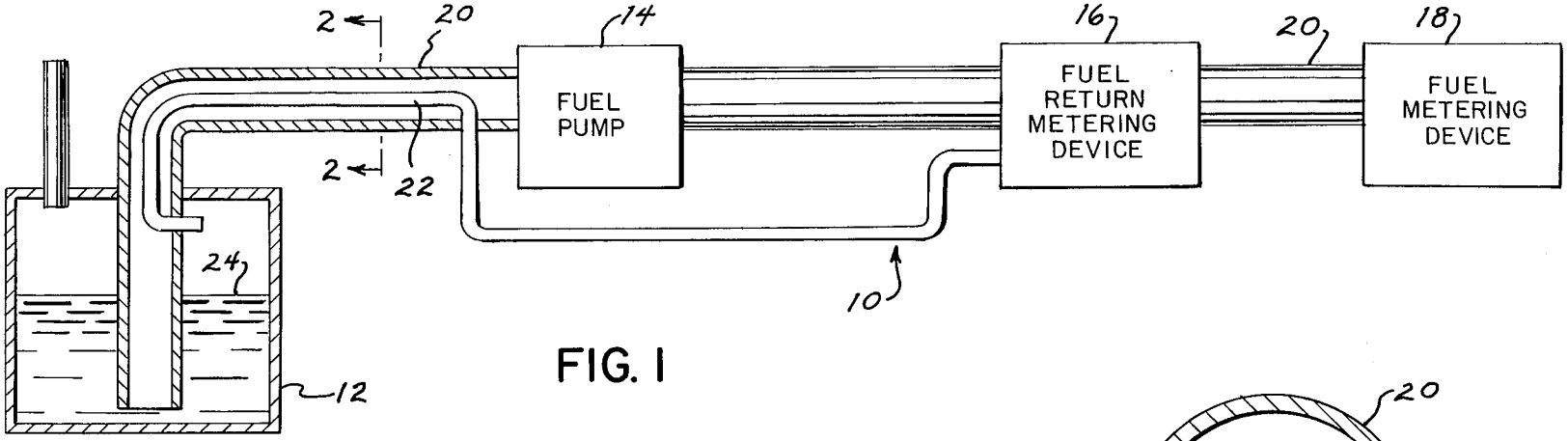
FIG. 1 schematically shows a fuel supply line and fuel return line constructed according to the present invention.
Figure 2:
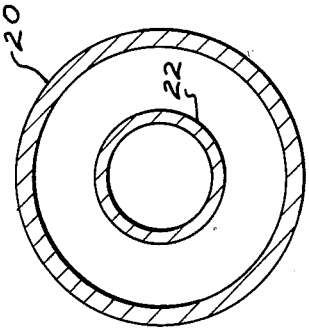
FIG. 2 is a cross-sectional view along the line 2—2 of FIG. 1.

FIG. 1 illustrates the major components of a marine engine fuel system 10. Such a system includes a fuel storage tank or reservoir 12, a fuel pump 14 for extracting fuel from tank 12, a fuel return metering device 16 for detecting fuel vapor or excess fuel and a fuel metering device 18.

In a typical fuel injected system, fuel return metering device 16 is a pressure regulator that diverts gasoline flow upon sensing a certain pressure in the downstream line.

Fuel metering device 18 typically is a fuel injection system or other system for monitoring and distributing fuel to the internal combustion engine (not shown).

Fuel is delivered from fuel tank 12 to fuel metering device 18 by means of fuel supply line 20.

When fuel return metering device 16 detects excess fuel or fuel vapor, the excess is returned to fuel tank 12 via fuel return line 22.

In the embodiment shown in FIG. 1, a portion of fuel return line 22 upstream of fuel pump 14 is co-axial with and contained within fuel supply line 20. Also, in the embodiment shown in FIG. 1, fuel return line 22 terminates in fuel tank 12 at a point above the level of fuel 24. Since the pressure in fuel return line 22 is greater than that of fuel supply line 20, a rupture in the co-axial portion of fuel return line 22 will result in the introduction of air from fuel tank 12 into fuel supply line 20. This introduction of air into fuel supply line 20 will cause the internal combustion engine to cease operating.

Figure 3:
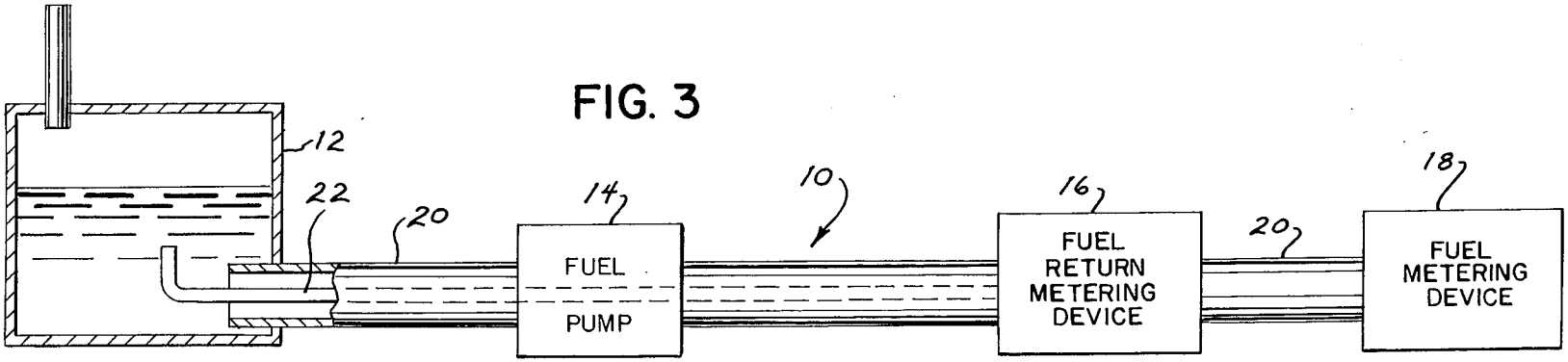
FIG. 3 schematically shows an alternate embodiment of the system of FIG. 1.

In FIG. 3, an alternate embodiment is shown in which the entire fuel return line 22 is coaxial with and contained within fuel supply line 20. In this embodiment, a rupture in fuel return line 22 is always contained within fuel supply line 20 and engine operation will not be effected by such a rupture.

It is recognized that various alternatives and modifications are possible in the scope of the appended claims.

I claim:

1. In a gasoline fuel system for an internal combustion engine having a fuel pump communicating with a fuel tank and delivering fuel to a device for introducing measured amounts of fuel into the engine and including a device for detecting and returning vaporized fuel and excess fuel to the tank, a fuel line connecting these components comprising:

a supply conduit for delivering fuel from the tank to the engine via the fuel pump, the detecting device and the measuring device and a return conduit for returning detected vaporized or excess fuel to the tank with at least a portion of said return conduit co-axial with and contained within said supply conduit to prevent the escape of fuel vapor to the atomosphere.

2. The fuel system of claim of claim 1 wherein said fuel line comprises a first section connecting the fuel tank to the fuel pump and a second section connecting the fuel pump to the detection device and the return conduit is coaxial with and contained within the supply conduit in said first section along substantially the entire length of said first section.

3. In a fuel system for an internal combustion engine having a fuel pump communicating with a fuel tank and delivering fuel to a device for introducing measured amounts of fuel into the engine and including a device for detecting and returning vaporized fuel and excess fuel to the tank, a fuel line connecting these components comprising:

a supply conduit for delivering fuel from the tank to the engine via the fuel pump, the detecting device and the measuring device and a return conduit for returning detecting vaporized or excess fuel to the tank with at least a portion of said return conduit co-axial with and contained within said supply conduit, wherein:

said fuel line comprises a first section connecting the fuel tank to the fuel pump and a second section connecting the fuel pump to the detection device and the return conduit is co-axial with and contained within the supply conduit in said first section;

the return conduit is co-axial with and contained within the supply conduit in said second section.

4. The fuel system of claim 1 wherein the end of said return conduit communicating with the fuel tank is disposed above the level of fuel in the fuel tank.

5. In a fuel system for an internal combustion engine having a fuel pump communicating with a fuel tank and delivering fuel to a device for introducing measured amounts of fuel into the engine and including a device for detecting and returning vaporized fuel and excess fuel to the tank, a fuel line connecting these components comprising:

a supply conduit for delivering fuel from the tank to the engine via the fuel pump, the detecting device and the measuring device and a return conduit for returning detecting vaporized or excess fuel to the tank with at least a portion of said return conduit co-axial with and contained within said supply conduit, wherein:

the end of said return conduit communicating with the fuel tank is disposed above the level of fuel in the fuel tank;

the pressure in said supply conduit is less than that in said return conduit so that a rupture in said return conduit causes air from the fuel tank to be introduced into said supply conduit via said return conduit.

* * * * *